US007434544B2

(12) United States Patent
Donnelly et al.

(10) Patent No.: US 7,434,544 B2
(45) Date of Patent: Oct. 14, 2008

(54) WATER HEATER WITH DRY TANK OR SEDIMENT DETECTION FEATURE

(75) Inventors: Donald E. Donnelly, St. Louis, MO (US); Jeffrey N. Arensmeier, St. Louis, MO (US); Herbert G. Ray, St. Louis, MO (US)

(73) Assignee: Emerson Electric Co., St. Louis, MS (US)

( * ) Notice: Subject to any disclaimer, the term of this patent is extended or adjusted under 35 U.S.C. 154(b) by 32 days.

(21) Appl. No.: 11/475,533

(22) Filed: Jun. 27, 2006

(65) Prior Publication Data

US 2007/0295286 A1 Dec. 27, 2007

(51) Int. Cl.
*F24H 9/20* (2006.01)

(52) U.S. Cl. ..... 122/14.22

(58) Field of Classification Search ..... 122/14.22, 122/14.2, 14.21

See application file for complete search history.

(56) References Cited

U.S. PATENT DOCUMENTS 3,948,439 A 4/1976 Heeger ..... 236/21 B
4,638,789 A * 1/1987 Ueki et al. ..... 122/14.21
5,125,068 A * 6/1992 McNair et al. ..... 392/441
6,053,130 A * 4/2000 Shellenberger ..... 122/14.21
6,606,968 B2 * 8/2003 Iwama et al. ..... 122/18.1
6,701,874 B1 * 3/2004 Schultz et al. ..... 122/14.2
6,880,493 B2 * 4/2005 Clifford ..... 122/14.22
7,032,542 B2 * 4/2006 Donnelly et al. ..... 122/14.2
7,167,813 B2 * 1/2007 Chian et al. ..... 702/183

* cited by examiner

*Primary Examiner*—Gregory A Wilson
(74) *Attorney, Agent, or Firm*—Harness, Dickey & Pierce, P.L.C.

(57) ABSTRACT

One or more embodiments of a controller for controlling a fuel-fired water heater are provided that are able to detect a high rate of temperature change condition in the water heater tank. The fuel fired water heater appliance having a water storage vessel comprises a surface mount sensor disposed on the outer surface of the storage vessel near the bottom of the vessel, for sensing the temperature of the vessel. The controller monitors the rate of change of the temperature sensed by the surface mount sensor during a heating cycle, and discontinues operation of the water heater appliance upon detecting an increase in the rate of temperature change that is indicative of an undesirable level of sediment build-up in the water storage vessel.

16 Claims, 1 Drawing Sheet

WATER HEATER WITH DRY TANK OR SEDIMENT DETECTION FEATURE

FIELD OF THE INVENTION

The present invention relates to water heaters, and more particularly to the operation of fuel-fired water heaters.

BACKGROUND OF THE INVENTION

Water heaters tend to buildup lime or other sediment in the bottom of the storage vessel over time, which sediment increases the thermal insulation of the vessel and lowers the heat transfer through the bottom of the vessel into the stored water. This sediment build up can cause an increase in the temperature of the lining of the storage vessel during heating operation as the result of the thermal insulating effect. In addition, the efficiency of the water heater is decreased, because more fuel is required to heat the stored water as a result of the insulating sediment.

SUMMARY OF THE INVENTION

Various embodiments of a controller for controlling a fuel-fired water heater are provided that are able to detect a high rate of temperature change condition in the water heater tank. In accordance with one aspect of the present invention, one embodiment of a controller for a fuel fired water heater appliance having a water storage vessel comprises a surface mount sensor disposed on the outer surface of the storage vessel near the bottom of the vessel, for sensing the temperature of the vessel. The controller monitors the rate of change of the temperature sensed by the surface mount sensor during a heating cycle, and discontinues operation of the water heater appliance upon detecting a rate of temperature increase that is indicative of an undesirable level of sediment build-up in the water storage vessel. In some embodiments, the controller includes a processor configured to periodically read the temperature signal from the sensor during a period of heating operation and to determine at least one sensed rate of temperature change during a heating cycle, wherein the processor uses the sensed rate of temperature change during one or more periods of heating operation over a predetermined length of time to determine a baseline rate of temperature change. The processor provides a fault signal indicating an undesirable level of sediment build-up in the storage vessel when the sensed rate of temperature change during a heating cycle is more than a predetermined amount above the base line rate of temperature change.

In accordance with another aspect of the present invention, another embodiment of a controller includes a processor configured to periodically read the temperature signal from the sensor at given time intervals during a period of heating operation to determine at least one representative sensed rate of temperature change during the heating period, wherein the processor uses the representative rate of temperature change during one or more periods of heating operation over a predetermined length of time to determine a baseline rate of temperature change. The processor may be configured to provide a warning signal alerting a user of the water heater that the water heater has an undesirable level of sediment build-up in the storage vessel when the sensed rate of temperature change during a period of heating operation is more than a first predetermined amount above the base line rate of temperature change. The processor may also be configured to shut down the water heater and provide a fault signal indicating an unsafe level of sediment build-up in the storage vessel, upon sensing a rate of temperature change during a period of heating operation that is more than a second predetermined amount above the base line rate of temperature change.

In yet another aspect of the present invention, some embodiments of a controller may further shut down the water heater and provide a fault signal indicating the occurrence of a dry tank condition in the storage vessel when the sensed rate of temperature change during a period of heating operation that is greater than a third predetermined rate of temperature change, which is indicative of a dry tank condition.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

Figure 1:
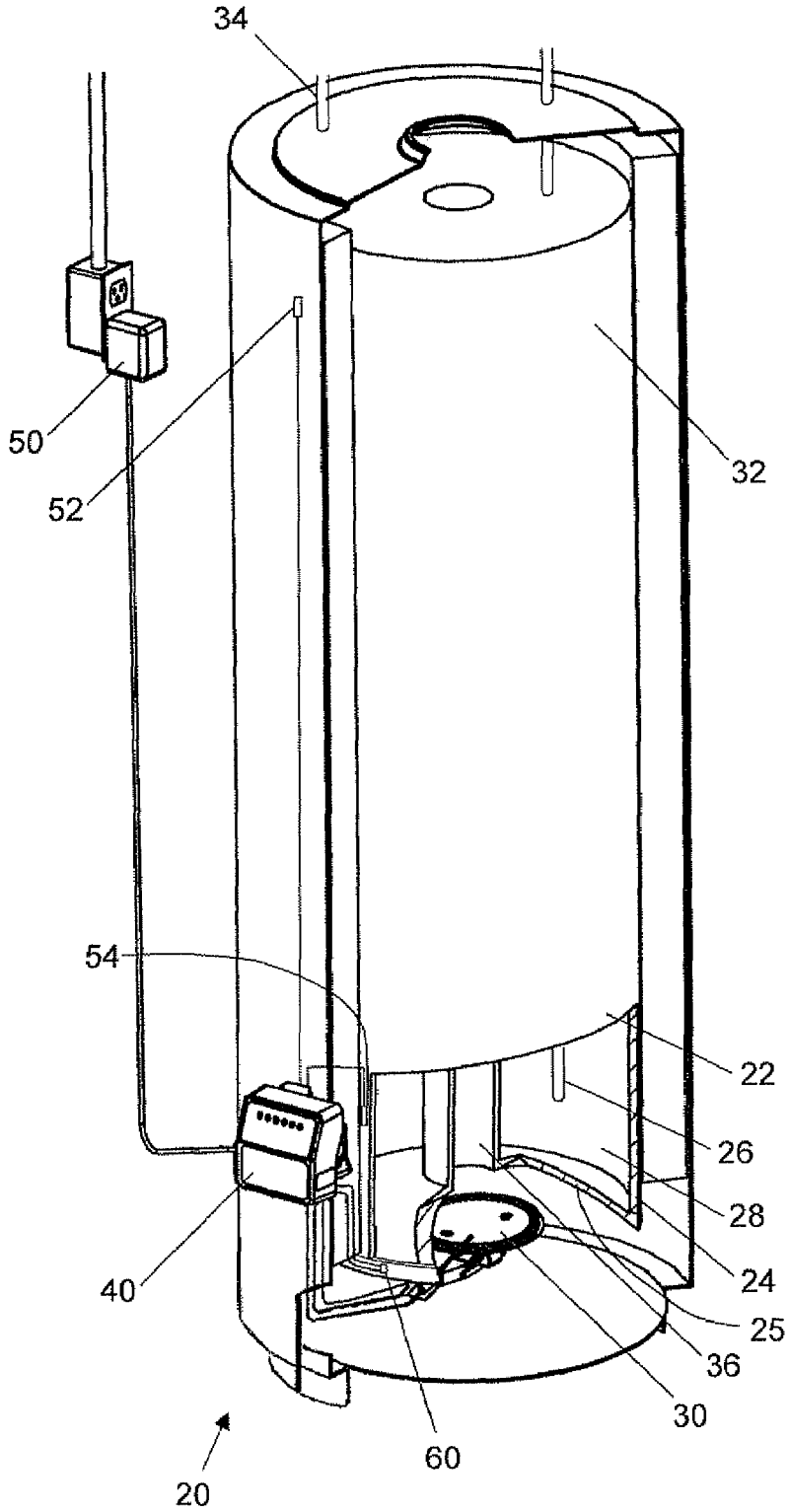
FIG. 1 is a cut-away illustration of a water heater having a temperature change sensing feature according to the principles of the present invention.

The following description of the various embodiments is merely exemplary in nature and is in no way intended to limit the invention, its application, or uses.

One embodiment of a controller for a fuel fired water heater appliance is shown generally as 20 in FIG. 1. The heater 20 has a storage tank 22 that has a glass lined interior, which receives cold water via a cold water inlet 26. Cold water entering the bottom 28 of the tank 22 is heated by a fuel-fired heating apparatus 30 beneath the tank. The heating apparatus 30 can be lighted, for example, using an igniter (not shown). Water that is heated in the storage tank rises to the top 32 of the tank and leaves the tank via a hot water pipe 34. Combustion gases leave the heater via a flue 36. An electrically operated solenoid gas valve provides control of gas flow through a gas supply line 38 to the heating apparatus as further described below.

The water heater 20 includes a controller 40 positioned, for example, adjacent the tank 22. As further described below, the controller 40 is configured to responsively activate or deactivate the igniter and the gas valve, as further described below.

A surface-mounted sensor 52 connected to the controller 40 provides a value that is indicative of the temperature near the top of the tank 32. This sensed temperature is reflective of the temperature of the water near the top of the tank. To prevent scalding, the controller 40 can shut off a heating apparatus 30 if the sensor 52 senses a temperature that exceeds a predetermined value. A second sensor 54 may also be employed at the bottom of the tank 28 near the cold water inlet 28. Cold water entering the tank 22 thus affects the output of sensor 54.

The controller 40 may further comprise a processor (not shown) for controlling the operation of the igniter and at least one solenoid gas valve switch associated with the heating apparatus. The controller preferably receives power from a 120 VAC line, but may alternatively be powered by a 24-volt plug-in transformer 50 is plugged into a line voltage source, e.g., a receptacle outlet of a 120 VAC line. Thus, the transformer 50 can be plugged into a voltage source remote from the controller 40, to provide a stepped-down voltage to the controller 40.

The controller 40 monitors the temperature of the water at the bottom of the tank, either by monitoring the output of sensor 54 or by monitoring a sensor 60 that is disposed on the bottom of the water storage vessel near the heating apparatus. If the controller 40 determines, for example, that a rapid drop in temperature has occurred, then the controller 40 determines that water is being drawn from the tank 22 and controls the heater 20 accordingly as further described below. Sensitivity to sensor output may be programmed into the processor 40, to avoid establishing a call for heat on every water draw.

The water heater appliance 20 comprises a water storage vessel or tank 22, which stores water that is heated by a fuel fired heating apparatus 30 located below the water storage vessel 22. Typically, water heaters typically experience lime or other sediment build up in the bottom of the storage vessel 22, which creates an insulating effect that lowers the heat transfer through the bottom of the vessel into the stored water. With less heat being transferred or conducted through the storage vessel and sediment into the stored water during operation of the heating apparatus 30, the bottom of the storage vessel 22 can become over-heated. This over-heating lowers the life of the water heater, and can lead to possible failure of the water storage vessel 22.

In a water heater of the present invention, the rate of temperature increase of the bottom of the water storage vessel 22 during heating operation reflects the rate of heat transfer into the water storage vessel 22. As the sediment steadily builds up, the rate at which heat may be transferred into the water decreases. The bottom of the water storage vessel will accordingly retain more heat during operation of the heating apparatus 30, and will gradually reach higher and higher temperatures. In some water heater appliances, the temperature of the bottom of the water storage vessel 22 may rise to as much as 350 degrees Fahrenheit during heating operation. Prolonged exposure to high temperature will cause the glass lining on the interior of the water storage vessel 22 to crack, and lead to the tank rusting out.

The temperature that a storage tank wall or lining may reach during heating operation can depend on various factors, including the inlet water temperature, the temperature setting for the water to be heated, the duration of a heating cycle, and the temperature of the space in which the water heater is installed. These factors can each affect the temperature level that the water storage vessel may reach during a period or cycle of heating the water stored in the tank. Moreover, the temperature of the bottom 25 of the storage vessel directly above the heating apparatus may be as much as 300 degrees Fahrenheit, while near the sides 24 the temperature may be only 150 Fahrenheit. Positioning of a sensor 60 on the bottom 25 can greatly affect the sensor output, due to the temperature gradient along the bottom surface of the tank. As such, discontinuing operation of the water heater 20 when a sensor 60 senses a storage vessel temperature that exceeds a pre-set temperature limit would be impractical, and could lead to the unnecessary nuisance of premature shut down of the water heater.

In some embodiments of the present invention, a surface mount sensor 60 is disposed near the bottom of the storage vessel on the outer surface, to provide an output that is indicative of the temperature of the bottom of the storage vessel. The surface mount sensor 60 is in communication with the controller 40, which periodically reads the value of the sensor 60 that is indicative of the storage vessel temperature. The controller 40 is configured to determine the rate of temperature change based on the sensed temperature values over an interval of time during a heating cycle. While the maximum temperature of the tank bottom wall may vary based on numerous conditions and does not reflect the level of sediment build-up, the rate of temperature change of the storage tank bottom surface provides a better indication of sediment build up.

In at least one embodiment, the controller reads the output of sensor 60 at various intervals during a cycle of operation of the heating apparatus, to determine at least one rate of temperature change. For example, in a typical 40 gallon residential fuel-fired water heater, a sensor 60 at the bottom of the storage tank may detect an increase of about 1 degree Fahrenheit per minute during a heating cycle. The controller 40 is configured to monitor at least one rate of temperature change during a heating cycle, for comparison to a standard. The controller compares the rate of temperature change with a first predetermined rate of temperature change that is indicative of an undesirable level of sediment build-up in the water storage vessel. When the controller detects a rate of temperature change sensed by the surface mount sensor 60 that exceeds the stored predetermined rate, the controller provides a fault signal or alarm for alerting the home owner of an undesirable sediment buildup. The controller may also shut down the water heater and provide a signal indicating that the water heater operation has been discontinued due to an undesirable level of sediment build up that could cause the water heater storage tank to fail or rupture. The controller may also be configured to detect a rate of temperature change sensed by the surface mount sensor that exceeds a second predetermined rate that is indicative of an unsafe level of sediment in the storage tank, and to responsively discontinue operation of the heating apparatus. The controller may be adapted to discontinue operation of the heating apparatus indefinitely until the controller is reset.

In another embodiment, the controller reads the sensor output at intervals during a cycle of operation of the heating apparatus to determine at least one rate of temperature change. The controller monitors at least one rate of temperature change during one or more cycles of operation of the heating apparatus, and compares the rate of temperature change to a first predetermined rate of temperature change that is indicative of an undesirable level of sediment build-up in the water storage vessel. When the controller detects a rate of temperature change sensed by the surface mount sensor that exceeds the stored predetermined amount, the controller discontinues operation of the water heater appliance. In one embodiment, the predetermined rate of temperature change may be 1.5 degrees per minute, for example. The controller further provides a fault signal, alarm or other indication to alert the home owner that the water heater operation has been discontinued due to an undesirable level of sediment build up, which could cause the water heater storage tank to fail or rupture.

In some embodiments, a controller is provided that stores at least one rate of temperature change during one or more cycles of operation of the heating apparatus. The one or more cycles may be a predetermined number of successive heating cycles that are averaged, or may be an average of every fourth or fifth cycle up to a predetermined number. It is noted that any pattern of monitoring may be used to provide a time-based method for monitoring the rate of temperature change in the storage tank over time. The controller accordingly maintains data on the rate of temperature change for the water storage vessel over time, which may be used to establish an initial baseline rate of temperature change. The data may also be used to determine when an undesirable level of sediment build-up has occurred. For example, the controller may average the rate of temperature change data obtained during an initial period of use of the water heater, to establish a base line rate of temperature change for the water storage vessel. This baseline rate of temperature change may be about 1 degree per minute, for example. Alternatively, the base line rate of temperature change may be the temperature change that occurs over a complete heating cycle, or an average overall temperature change of several heating cycles. When the controller detected a rate of temperature change sensed by the surface mount sensor that is more than a predetermined percentage above the base line rate of temperature change, the controller provides a fault signal or alarm for alerting the home owner that the water heater operation has been discontinued due to an undesirable level of sediment build up that could cause the water heater storage tank to fail or rupture. In one embodiment of a controller, the predetermined amount may be a rate of temperature change that is 40 percent more than the baseline rate of temperature change, over a time period of six months or less. For example, the controller may initially monitor sensor 60 and observe an average rate of temperature change of 1.25 degrees per minute, and would provide a warning signal upon detecting a rate of temperature change of 1.75 degrees per minute. Alternatively, the predetermined amount may be 15 degrees more than the baseline temperature increase for a complete heating cycle. For example, the controller 40 may monitor sensor 60 and observe an average overall temperature increase of 20 degrees during a complete heating cycle, and would provide a warning signal upon detecting an overall temperature increase of 35 degrees during a heating cycle. The controller 40 may further discontinue water heater operation upon detecting an unacceptable rate of temperature increase, and may alert the home owner that the water heater operation has been discontinued.

It should be noted that an adjustment by an occupant to increase the desired water temperature setting would cause a sudden increase in the output of sensor 60 during a heating cycle. The controller 40 however, would be aware of a desired water temperature adjustment made by a user. The controller 40 would read the output of sensor 60 and offset the value by the adjustment difference, or the difference between the post-adjustment sensed output and the pre-adjustment sensed output. As such, the controller 40 would be able to continue monitoring the rate of temperature change without being affected by user adjustment of the temperature setting.

In yet another embodiment, the controller is configured to periodically read the temperature signal from the sensor at given time intervals during a period of heating operation to determine at least one representative sensed rate of temperature change during the heating period, wherein the processor uses the representative rate of temperature change during one or more periods of heating operation over a predetermined length of time to determine a baseline rate of temperature change. In one embodiment, the representative rate of change may be the maximum rate of temperature change that occurs in any interval of time during which the heating apparatus is in operation. The controller may be further configured to store the maximum sensed rate of temperature change that occurred during any interval of time within a cycle of operating the heating apparatus, and may store the maximum rate of temperature change for one or more cycles of heating operation of the heating apparatus. The controller may be configured to continuously store the maximum rate of temperature change for each cycle of operation of the heating apparatus, or to selectively store the maximum rate of temperature change in intermittent cycles. It is noted that any pattern of monitoring may be used to provide a time-based method for monitoring the rate of temperature change in the storage tank over time. The controller may use the time based data to create both an initial base line rate of temperature change, and a profile of the maximum sensed rate of temperature change of the storage tank over time. The controller may then be able to determine when the rate of temperature change has increased by more than a predetermined percentage that is indicative of an undesirable level of sediment build up. The controller may further be able to estimate or predict when a possible tank failure may occur in the future as a result of the sediment build-up, and provide an indication to alert the home owner of the predicted time of possible storage tank failure.

In the event of a dry tank condition where the storage tank has no stored water or much less than during normal conditions, the temperature of the storage tank vessel may rapidly increase. Such a dry tank condition may occur due to a intermittent loss of water supply pressure, and repeated overheating of the stored water that causes a pressure relief valve to release water from the tank. In the absence of normal water levels in the storage vessel, the sensed rate of temperature on the bottom of the storage vessel will greatly exceed the pre-set rate or percentage increase over a base line rate of the controller. In this situation, the controller is configured to recognize a rate of change that is greater than a third predetermined rate of temperature change that is indicative of a dry tank condition. When the controller detected a rate of temperature change sensed by the surface mount sensor that is more than the third predetermined maximum rate of temperature change, the controller provides a fault signal or alarm for alerting the home owner that the water heater operation has been discontinued.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A controller for controlling the operation of a fuel fired water heater appliance having a water storage vessel and a fuel fired heating apparatus located below the water storage vessel, the controller comprising:

a first sensor disposed at an upper portion of the storage vessel for sensing the temperature of the water in an upper portion of the storage vessel;

a second sensor disposed at a lower portion of the storage vessel for sensing the temperature of the water in a lower portion of the storage vessel;

a surface mount sensor disposed on the outer surface of the storage vessel at the bottom of the vessel, for sensing the temperature of the bottom of the vessel, wherein the surface mount sensor is configured to provide output data associated with the temperature of the bottom of the vessel over time that signifies an undesirable level of sediment build-up; and a controller that monitors the rate of change of the temperature of the bottom of the vessel sensed by the surface mount sensor during a heating cycle, and discontinues operation of the water heater appliance upon detecting a rate of temperature increase of the bottom of the vessel that is indicative of an undesirable level of sediment build-up in the water storage vessel.

2. The controller of claim 1, wherein the rate of temperature increase is in the range of about 20 degrees Fahrenheit to about 35 degrees Fahrenheit.

3. The controller of claim 1, wherein the controller provide a fault signal to alert a user of the water heater of the undesirable level of sediment build-up in the water storage vessel.

4. A controller for a water heater appliance having a fuel-fired heating apparatus, the controller comprising:

a first sensor disposed at an upper portion of the storage vessel for sensing the temperature of the water in an upper portion of the storage vessel;

a second sensor disposed at a lower portion of the storage vessel for sensing the temperature of the water in a lower portion of the storage vessel;

a third sensor disposed on the outer surface of the storage vessel at the bottom of the vessel, for providing a signal indicative of the temperature of the bottom of the storage vessel; and a processor that periodically reads the temperature signal from the third sensor and determines at least one rate of temperature change of the bottom of the vessel during a cycle of heating apparatus operation, and discontinues operation of the heating apparatus when the controller detects a rate of temperature change of the bottom of the vessel that exceeds a predetermined rate of change that is indicative of an undesirable level of sediment build-up in the water storage vessel.

5. The controller of claim 4, wherein the processor is further capable of providing a fault signal to alert a user of the water heater of the undesirable level of sediment build-up in the water storage vessel.

6. A controller for a water heater appliance having a fuel-fired heating apparatus, the controller comprising:

a first sensor disposed at an upper portion of the storage vessel for sensing the temperature of the water in an upper portion of the storage vessel;

a second sensor disposed at a lower portion of the storage vessel for sensing the temperature of the water in a lower portion of the storage vessel;

a third sensor disposed on the outer surface of the storage vessel at the bottom of the vessel, for providing a signal indicative of the temperature of the bottom of the storage vessel; and a processor configured to periodically read the temperature signal from the third sensor during a period of heating operation and to determine at least one sensed rate of temperature change of the bottom of the vessel during a heating cycle, wherein the processor uses the sensed rate of temperature change of the bottom of the vessel during one or more periods of heating operation over a predetermined length of time to determine a baseline rate of temperature change, and the processor provides a fault signal indicating an undesirable level of sediment build-up in the storage vessel when the sensed rate of temperature change of the bottom of the vessel during a heating cycle is more than a predetermined amount above the base line rate of temperature change for the bottom of the vessel; wherein the processor provides a fault signal indicating the occurrence of a dry tank condition in the storage vessel when the sensed rate of temperature change during a period of heating operation that is greater than a predetermined rate of temperature change that is indicative of a dry tank condition.

7. The controller of claim 6 wherein the processor further discontinues operation when the sensed rate of temperature change exceeds the predetermined amount.

8. The controller of claim 7 wherein the predetermined amount is a percentage of the baseline rate of temperature change.

9. The controller of claim 8 wherein the processor further discontinues operation when the sensed rate of temperature change exceeds the third predetermined amount indicative of a dry tank condition.

10. A controller for a water heater appliance having a fuel-fired heating apparatus, the controller comprising:

a first sensor disposed at an upper portion of the storage vessel for sensing the temperature of the water in an upper portion of the storage vessel;

a second sensor disposed at a lower portion of the storage vessel for sensing the temperature of the water in a lower portion of the storage vessel;

a third sensor disposed on the outer surface of the storage vessel at the bottom of the vessel, for providing a signal indicative of the temperature of the bottom of the storage vessel; and a processor configured to periodically read the temperature signal from the sensor at given time intervals during a period of heating operation to determine at least one representative sensed rate of temperature change of the bottom of the vessel during the heating period, wherein the processor uses the representative rate of temperature change of the bottom of the vessel during one or more periods of heating operation over a predetermined length of time to determine a baseline rate of temperature change for the bottom of the vessel, and the processor provides a warning signal alerting a user of the water heater that the water heater has an undesirable level of sediment build-up in the storage vessel when the sensed rate of temperature change of the bottom of the vessel during a period of heating operation is more than a first predetermined amount above the base line rate of temperature change for the bottom of the vessel, and the processor provides a fault signal indicating an unsafe level of sediment build-up in the storage vessel when the sensed rate of temperature change of the bottom of the vessel during a period of heating operation is more than a second predetermined amount above the base line rate of temperature change for the bottom of the vessel, wherein the processor provides a fault signal indicating the occurrence of a dry tank condition in the storage vessel when the sensed rate of temperature change during a period of heating operation that is greater than a third predetermined rate of temperature change that is indicative of a dry tank condition.

11. The controller of claim 10 wherein the processor further discontinues operation when a sensed rate of temperature change during a period of heating operation exceeds the second predetermined amount.

12. The controller of claim 11 wherein the predetermined amount is a percentage of the baseline rate of temperature change.

13. The controller of claim 12 wherein the predetermined amount is about 120 percent of the baseline rate of temperature change.

14. The controller of claim 13 wherein the processor further discontinues operation when the sensed rate of temperature change exceeds the third predetermined amount indicative of a dry tank condition.

15. The controller of claim 14 wherein the predetermined amount is about 200 percent of the baseline rate of temperature change.

16. A fuel-fired water heater appliance comprising the controller of claim 10.

* * * * *